US010485363B2

(12) United States Patent
Son et al.

(10) Patent No.: US 10,485,363 B2
(45) Date of Patent: Nov. 26, 2019

(54) INFLATABLE PILLOW WITH ADJUSTABLE HEIGHT

(71) Applicant: GoSmart Inc., Los Angeles, CA (US)

(72) Inventors: Jae S. Son, Rolling Hills Estates, CA (US); Brandon M Larson, El Segundo, CA (US)

(73) Assignee: Go Smart, Inc., Los Angeles, CA (US)

( * ) Notice: Subject to any disclaimer, the term of this patent is extended or adjusted under 35 U.S.C. 154(b) by 326 days.

(21) Appl. No.: 15/600,770

(22) Filed: May 21, 2017

(65) Prior Publication Data

US 2018/0332982 A1 Nov. 22, 2018

(51) Int. Cl.
*A47G 9/10* (2006.01)

(52) U.S. Cl.
CPC ..... *A47G 9/1027* (2013.01)

(58) Field of Classification Search
CPC ..... A47G 9/10; A47G 9/1027; A47G 9/1081
USPC ..... 137/637
See application file for complete search history.

(56) References Cited

U.S. PATENT DOCUMENTS 2,943,621 A 7/1960 Phillips et al.
3,283,343 A 11/1966 Worcester
3,757,364 A 9/1973 Downing
3,763,509 A 10/1973 Mittenforf
4,093,944 A 6/1978 Muncheryan
4,916,765 A 4/1990 Castronovo
5,068,933 A * 12/1991 Sexton ..... A47C 27/082 5/644
5,686,882 A 11/1997 Giani
6,047,425 A * 4/2000 Khazaal ..... A47G 9/1027 5/640
6,317,908 B1 11/2001 Walpin
6,951,038 B1 * 10/2005 Ganoe, Sr. ..... A47G 9/1027 5/636
8,225,444 B2 * 7/2012 Chaffee ..... A47C 27/082 5/655.3
9,211,019 B2 * 12/2015 Driscoll, Jr. ..... A47C 27/082
2004/0222879 A1 11/2004 Sawyer et al.
2006/0005314 A1 1/2006 Lee
2006/0040803 A1 * 2/2006 Perez, Jr. ..... A47C 7/425 482/112
2007/0277903 A1 * 12/2007 Fawcett ..... B63C 9/24 141/329
2009/0223129 A1 * 9/2009 De Radigues ..... F17D 5/02 48/194
2012/0060292 A9 3/2012 Davis
2013/0019409 A1 * 1/2013 Blazar ..... A47G 9/1027 5/644
2016/0066716 A1 * 3/2016 Rao ..... A47G 9/1036 5/644

* cited by examiner

*Primary Examiner* — Robert G Santos
*Assistant Examiner* — Alexis Felix Lopez
(74) *Attorney, Agent, or Firm* — Boris Leschinsky

(57) ABSTRACT

A novel pillow is provided to easily adjust its height by pulling one or both levers of a unique double-lever air valve. Pulling a first lever opens up a smaller opening suitable for gradual deflation of the pillow and reducing its height under a pressure of a user head laying over the pillow. Pulling both levers together activates an electrically driven air pump to rapidly inflate the pillow through a larger opening so as to increase its height.

12 Claims, 15 Drawing Sheets

INFLATABLE PILLOW WITH ADJUSTABLE HEIGHT

BACKGROUND OF THE INVENTION

This invention relates to improvements in pillows such that an improved pillow allows the neck of a person who is lying on a bed to be in a neutral and comfortable position. Various embodiments of the improved pillow allow a user to easily adjust its heights.

For a sleeping pillow to be comfortable, it has to satisfy two very different and frequently conflicting requirements:

a. throughout the entire sleeping time, the pillow has to support a neck and a head of a user so as to assure normal, generally straight alignment of a spine, and
b. it has to distribute the pressure under the user's head so as to make it comfortable for the skin on the head and face of the user to rest on the pillow. This may be called Tactile Comfort Conventional pillows are generally made in a rectangular shape in one of only a few sizes and are generally filled by a plush down, or polyfill material. However, when a person's head is on the pillow the soft compliant materials compress dramatically and consequently many people try to compensate by using multiple pillows on top of one another. Manufacturers are reluctant to provide a broad range of pillow sizes due to increased production and inventory costs. These pillows frequently address the second requirement of distributing contact pressure by providing soft external surface for the head of the user to rest on but fail to satisfy the first requirement of providing proper height to keep the spine straight.

There are other fill material pillows that use buckwheat or memory foam that provide more support but at the price of reduced Tactile Comfort as they fail to broadly distribute contact pressures leading to reduce comfort.

Generally speaking, a conventional pillow has uniform thickness. When such pillow is too thin (too low) comparing to a distance corresponding to about half of the width of a user's shoulders, the neck of the user lying sideways bends downwards—see FIG. 3. In order to keep a side-lying user's neck straight, a thicker or stiffer pillow must be used to provide higher support when a head is on the pillow. But, when the pillow is too thick such as using two pillows (too high), the neck of the user bends upwards—see FIG. 2. The bent neck may pinch various nerves in the neck, in particular those nerves that come out from the Foramen inter-vertebrates. The pinches may hamper the relaxation or the rest of the nerves and may eventually cause pain in the upper body of a user. Nerve pinch can of course happen when there is not enough support as well. Therefore, a pillow that allows a user to keep a straight neck during sleep is needed.

Frequently, a user has to resort to using not one but a stack of two pillows or to fold the pillow or place their arm under the pillow to assure a proper height. In addition, the fill material of a pillow has a disadvantage of being compressed throughout the sleeping time causing a conventional pillow to gradually reduce its height overnight. Improper height of the pillow therefore causes discomfort and lack of a good night sleep.

In addition, common pillows do not allow for height adjustment tailored to a specific individual's size, mattress firmness and preference, which could change depending on the sleeping position. Known camping pillows are at least partially filled with foam pieces. These pillows feature a turn-on and turn-off valve to control air volume inside the pillow. A user can turn the valve on to open access to the inner inflatable bladder, then the user can inflate or deflate the pillow to a desired state and then the user needs to turn the valve off. Not only this is a long procedure, but it is difficult to adjust the pillow for comfortable sleep while the head of the user is on the pillow. Another disadvantage of these pillows is that the pillow often does not inflate to the maximum height unless the person blows into the valve since the size of the opening is limited making the inflation too restricted. These pillows may also not be optimal when it comes to the choice of foam and fill density.

There is a need therefore for an improved pillow which satisfies all of the above requirements.

SUMMARY OF THE INVENTION

Accordingly, it is an object of the present invention to overcome these and other drawbacks of the prior art by providing a novel pillow, which after initial height adjustment supports the head and neck of the user in a position aligned with the spine.

It is another object of the present invention to provide a new pillow which allows for an easy and rapid height adjustment, both in terms of increasing the height as well as decreasing the height of the pillow.

It is a further object of the present invention to provide a pillow shaped to support the head the user and the neck of the user at separate sections of the pillow so as to assure proper spine alignment, individual neck and head support and maximum user comfort.

It is yet a further object of the present invention to provide a pillow with built-in quiet wake-up alarm mechanism configured to wake up the user at a specified time but not disturb a partner.

The pillow 100 of the present invention is generally shown in FIG. 1 and includes an inflatable lower portion 130 covered at least on one side thereof by a comfort upper portion 110. The inflatable portion 130 of the pillow includes an inflatable bladder configured to adjust the height of the pillow by adding more air to the bladder or by removing some volume of air from the bladder. According to the experiments conducted by the inventors, different size openings are required for rapid adjustment of the pillow: a greater opening size is needed for rapid inflation of the bladder and a smaller opening size is needed for slow deflation of the pillow so as to achieve the desired height. A unique double-lever air valve may be provided in the valve section 140 of the pillow to achieve this configuration. As described in greater detail below, pulling one lever of the double-lever air valve opens up a first opening to the inflatable bladder allowing for controlled deflation of the bladder and reduction in height of the pillow 100. Pulling a second lever of the double-lever air valve opens up a second opening of the bladder while keeping the first opening still open so as to increase a total cross-section of both openings to speed up inflation of the bladder and increase in pillow height.

The upper comfort section 110 may be filled with any known pillow fill materials such as down, memory foam, polyfill, etc. The entire pillow may be enclosed in a pillow cover 180.

A quiet wake-up vibration alarm mechanism may also be provided to silently wake up the user and not disturb others.

BRIEF DESCRIPTION OF THE DRAWINGS

Subject matter is particularly pointed out and distinctly claimed in the concluding portion of the specification. The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

DETAILED DESCRIPTION OF THE PREFERRED EMBODIMENT OF THE INVENTION

Figure 1:
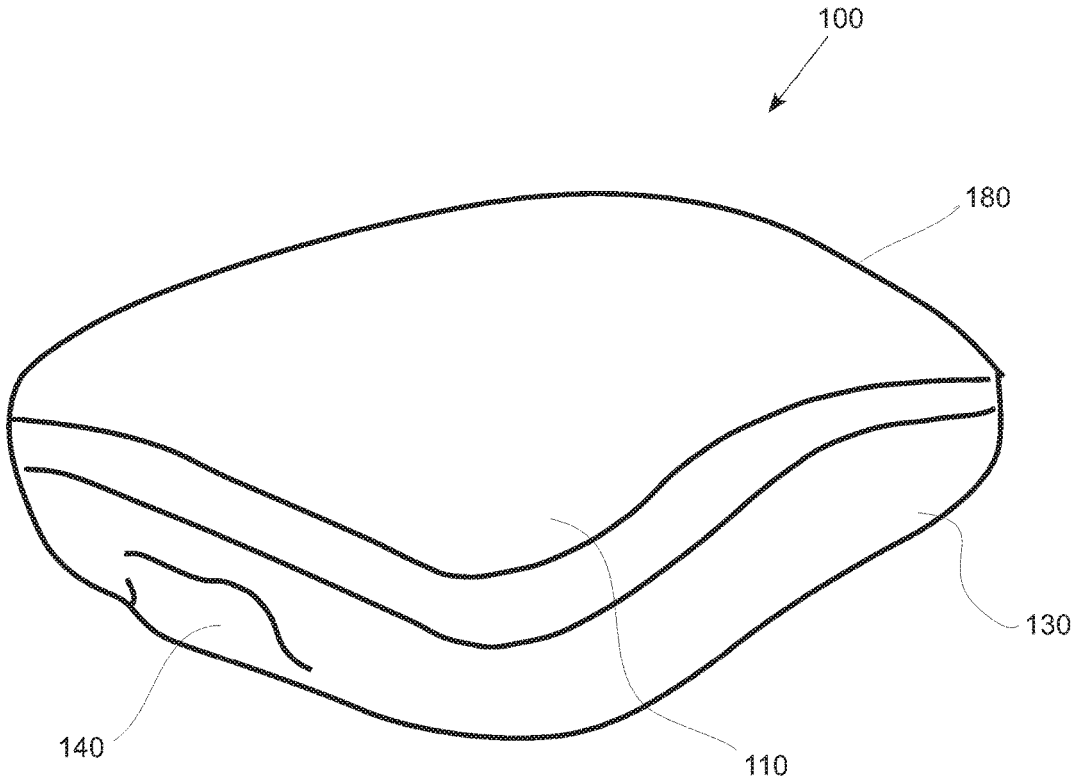
FIG. 1 is a general view of the pillow of the present invention.

The following description sets forth various examples along with specific details to provide a thorough understanding of claimed subject matter. It will be understood by those skilled in the art, however that claimed subject matter may be practiced without one or more of the specific details disclosed herein. Further, in some circumstances, well-known methods, procedures, systems, components and/or circuits have not been described in detail in order to avoid unnecessarily obscuring claimed subject matter. In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

Figure 7:
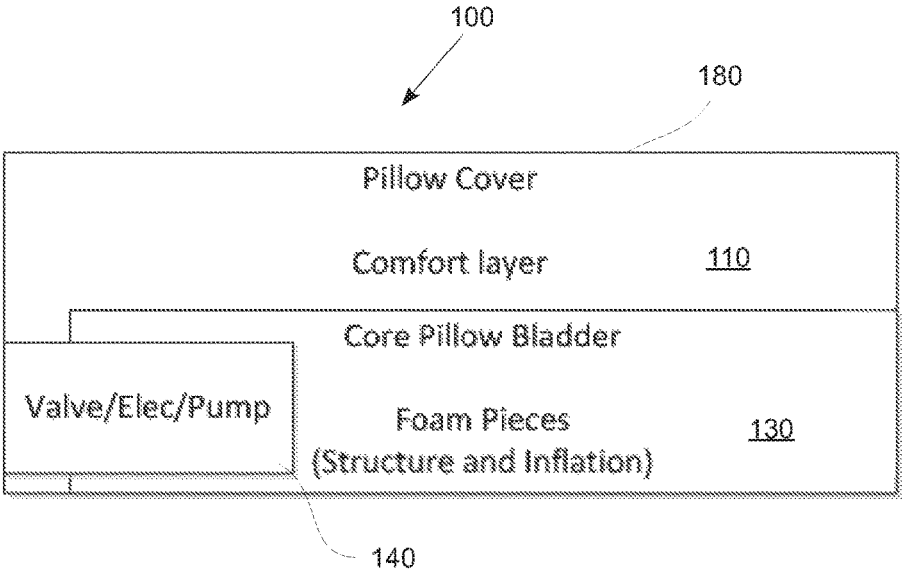
FIG. 7 is a block-diagram of the pillow of the present invention.

FIG. 1 shows a general view of the pillow 100 of the present invention and FIG. 7 shows a general block diagram thereof. The pillow 100 includes an inflatable lower portion 130 and a comfort upper portion 110. Although in this illustrations the comfort portion 110 is seen as covering the lower portion 130 on top only, it is also contemplated to have the comfort portion 110 surrounding the lower inflatable portion 130 on all sides or just on top and on the bottom. Both the lower inflatable portion 130 and the upper comfort portion 110 may be enclosed in a pillow cover 180 made from suitably soft and comfortable fabric. In embodiments, the lower portion 130 may be attached to the upper comfort portion 110 and not be enclosed in a pillow cover 180. A manual or electrically operated air control assembly 140 may be provided to facilitate adding air into the bladder or removing air therefrom in order to adjust the pillow height.

The upper comfort portion 110 may include an optional dedicated cover containing the fill material. Alternatively, other embodiments may contain a single piece of fill material or several pieces of fill material attached together and arranged to represent the upper comfort portion 110 without a dedicated cover holding the fill material together.

In embodiments, a variety of fill materials can be used for the purposes of supporting the user head and distribute pressure over the larger surface of the pillow 100. Down, polyfill, polyester, polyester pellets, microbeads, beanbag fillers, wool, shredded rubber, memory foam, polyurethane foam and other traditional materials may be used individually or in combination to fill the volume of the upper comfort portion 110 as the present invention is not limited in this regard.

Figure 2A:
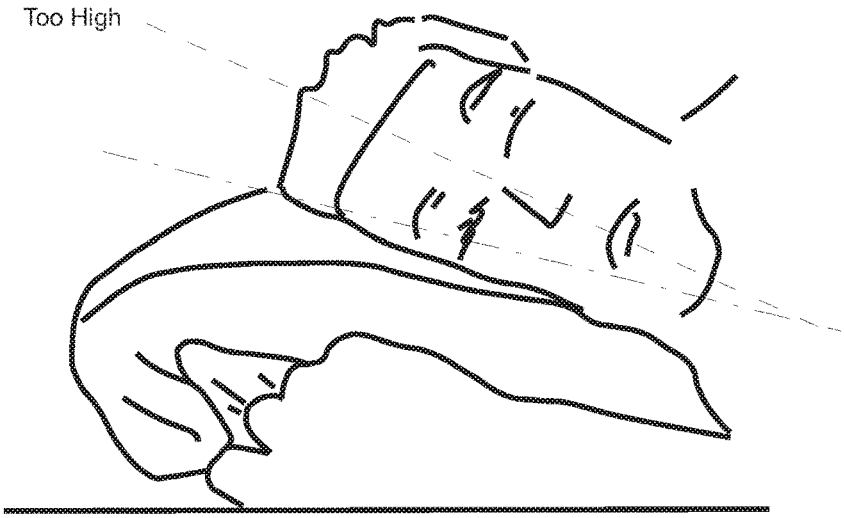
FIG. 2*a* is a side view of a user on a pillow, which is too high.
Figure 2B:
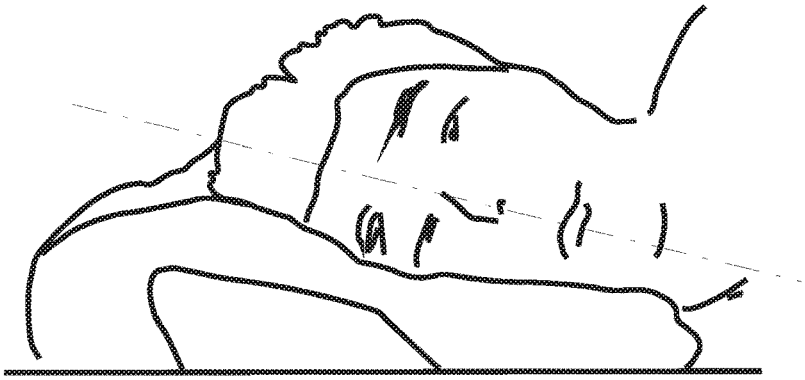
FIG. 2*b* is a side view of a user on a pillow, which is optimal.
Figure 2C:
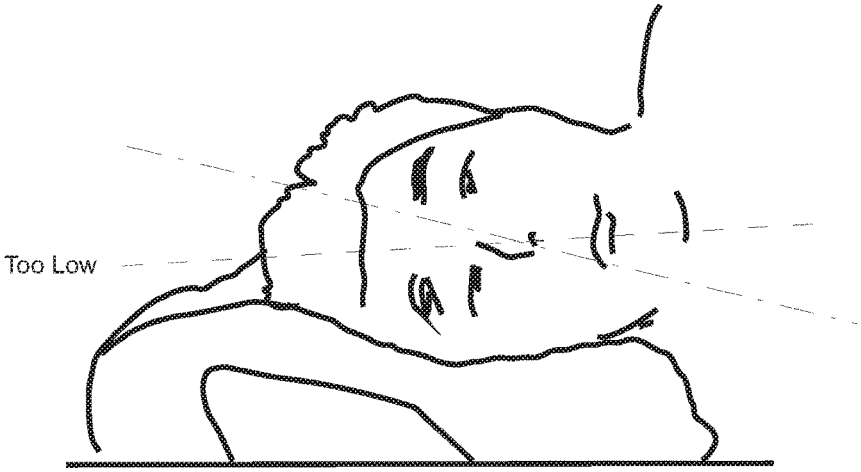
FIG. 2*c* is a side view of a user on a pillow, which is too low.

Before describing the lower inflatable portion of the pillow, it is important to discuss the need for height adjustment in greater detail. To achieve a good night sleep, it is important to allow muscle relaxation of all parts of the body. When it comes to an upper portion of the body, it is desirable to keep the head aligned with the general center line of the spine. For a side sleeper, this translates into a necessity to select the mattress softness along with the height and softness of the pillow appropriately. Selecting too high of a pillow tends to cause bending of the head upwards as seen in FIG. 2*a*. Too soft of a pillow or a shallow pillow tends to allow the head to bend downwards—see FIG. 2*c*. Proper alignment is seen in FIG. 2*b*. Utilizing a lower inflatable portion of the pillow may help in adjusting the pillow height to a desired level for a variety of individual users, whereby making it universally satisfactory for a broad range of customers, while at the same time reducing the cost of producing a large number of sizes and servicing a large inventory of products at the store.

Figure 3:
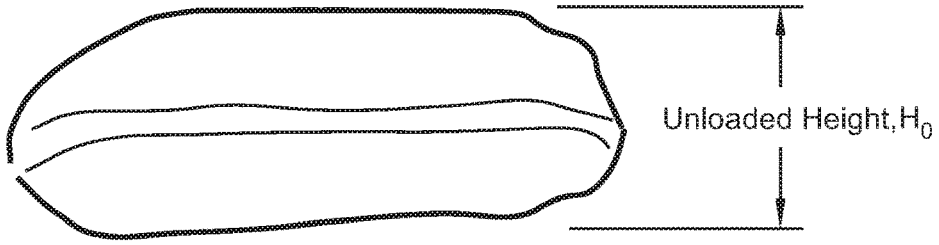
FIG. 3 is a general side view of the pillow in an unloaded state.

To further improve the ease of use of the pillow with an adjustable height, the inventors of the present invention have conducted a number of tests to evaluate the best inflation and deflation practices for an inflatable pillow. FIG. 3 shows an intact unloaded pillow characterized by initial undisturbed height $H_o$.

Figure 4:
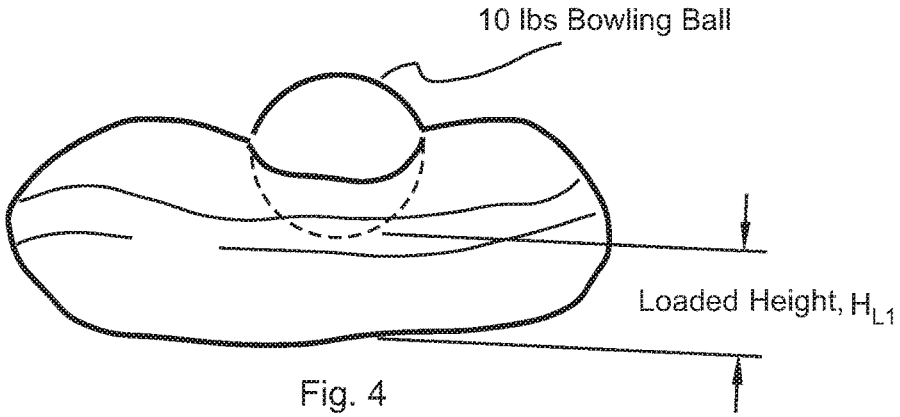
FIG. 4 is the same in a loaded state with a predefined load.

The tests were performed with a 10 lb bowling ball placed in the middle of the pillow and used to represent a typical human head—see FIG. 4. Placing the ball on the pillow results in a depression of the pillow height to a loaded height of $H_{L1}$.

Figure 5:
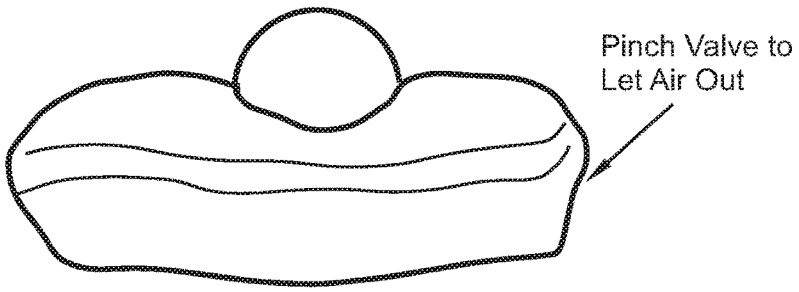
FIG. 5 is the same as in FIG. 4 but with a double-lever air valve activated to open a first opening suitable for deflation adjustment of the pillow under load.
Figure 6:
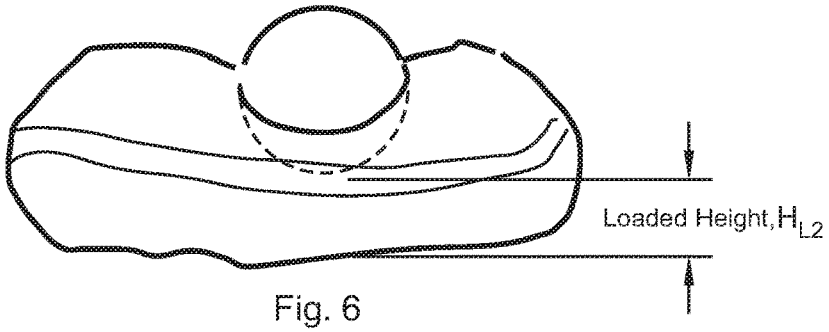
FIG. 6 is the same showing the height of the pillow after adjustment.

Tests to examine the impact of various size openings between the internal inflatable bladder of the pillow and atmosphere were conducted by releasing air from the bladder. One way to accomplish such release is via using a pinch valve (see FIG. 5)—releasing air causes the bladder to deflate at a rate corresponding to the size of the opening resulting in a lower pillow height $H_{L2}$—see FIG. 6.

Importantly, this test simulates the most preferred conditions of how the pillow height needs to be adjusted—while the user's head is resting on the pillow. In that case, the pressure differential urging the air out of the bladder is defined by the weight of the head—therefore simulating real life conditions. The rate of deflation needs to be slow enough to allow for a fine adjustment of the pillow height—too fast of a deflation would not allow the user to properly adjust the height of the pillow and to try different positions of the pillow while using it. At the same time, too small of an opening would cause excessively slow deflation of the pillow and therefore extending the time for the adjustment procedure unnecessarily.

These experiments resulted in a determination of an optimum size of a total opening during deflation, which is fast enough to be convenient and yet slow enough to allow for fine adjustments. In embodiments, the size of the bladder opening suitable for convenient deflation may be about 0.15, 0.20, 0.25, 0.30, 0.35 $in^2$ or any number inbetween.

In a separate series of tests, inventors of the present invention evaluated the minimum size of the opening needed for rapid inflation of the pillow. It was determined that a suitable total opening size needed for rapid inflation under 15 seconds is about 0.25 $in^2$. In embodiments, the cross-sectional area of an opening to the inflatable bladder may be at or above about 0.40 $in^2$ in order to achieve pillow inflation of about 10 seconds or less. Other openings may also be used such as 0.15, 0.20, 0.3, 0.4, 0.5 $in^2$ or any number inbetween.

As a result of these experiments, it became apparent that a suitable rate of pillow deflation in conditions of having a user head on the pillow and pushing it down is quite different from the suitable rate of pillow inflation. In embodiments it may be desired to have a rate of pillow deflation be lower than the rate of pillow inflation. To achieve this difference between the rate of pillow deflation and pillow inflation, the pillow of the present invention features a design allowing to change the cross-sectional area of the opening of the inflatable bladder.

In some embodiments, the adjustment of the opening may be made in a staged way. In other words, the opening size during deflation may have a smaller fixed value while the opening size during inflation may have a larger fixed value. In other embodiments, the size of the opening may be adjusted gradually over a range of values covering both preferred inflation and preferred deflation rates.

Figure 8:
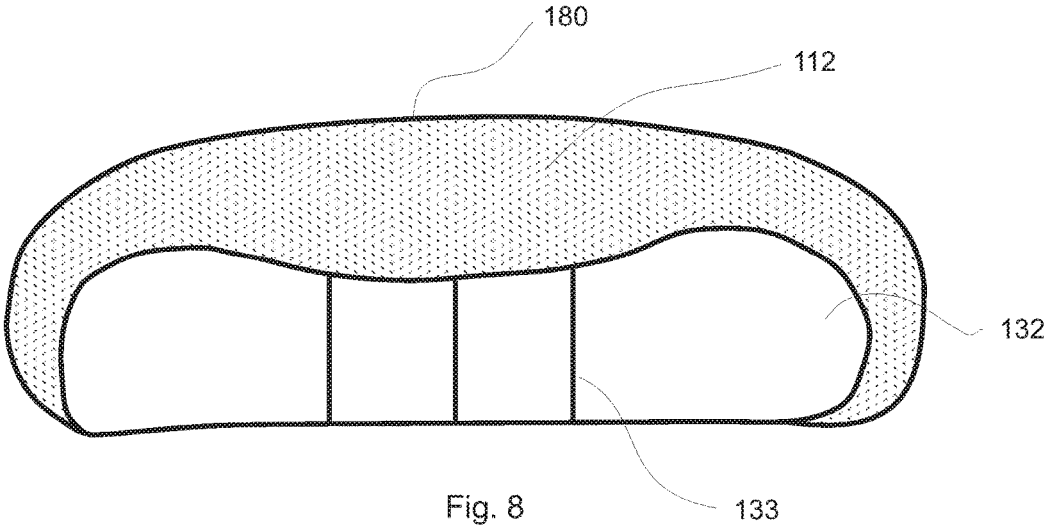
FIG. 8 is a general cross-sectional view of the pillow of the invention.
Figure 9:
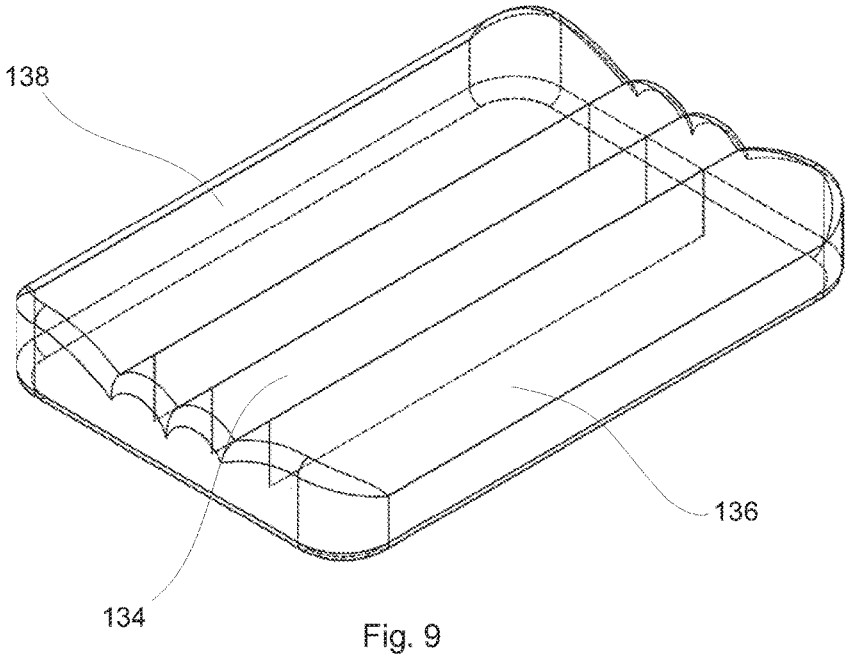
FIG. 9 is a general axisymmetric view of the inflatable bladder of the pillow.
Figure 10:
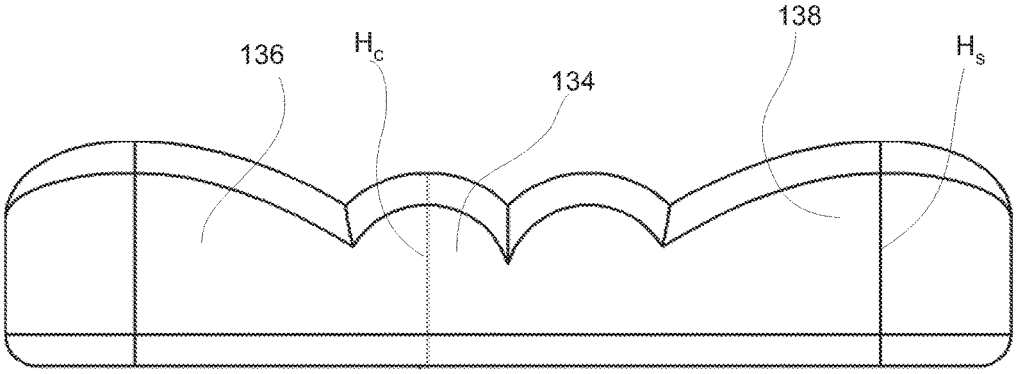
FIG. 10 is a general side view of the inflatable bladder.
Figure 11:
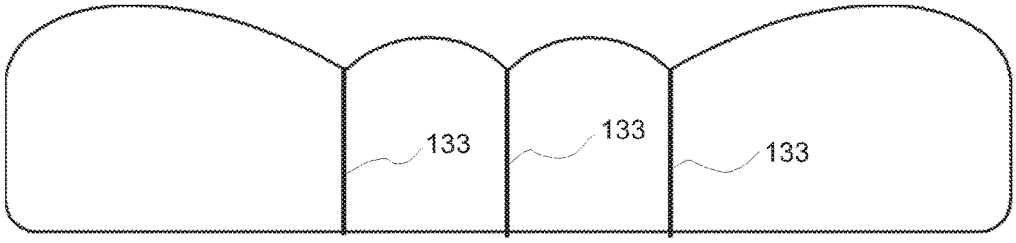
FIG. 11 is a general cross-sectional view of the inflatable bladder.

A general cross-sectional view of the pillow of the present invention is seen in FIG. 8. A pillow cover 180 is shown containing the fill material 112 located on top of the inflatable bladder 132. The bladder 132 may be shaped as a general rectangle and sized from about 9"×4" to about 13"×9". Using intermediate ribs 133, the bladder 132 may be shaped to include three sections: central section 134 of smaller height $H_c$ may be located inbetween side sections 136 and 138 of greater height $H_s$—see FIGS. 8 through 11. In embodiments, the height $H_c$ of the central portion 134 of the unloaded bladder 132 may be from about 2" to about 5", while when in use that height may be reduced to about 0.5" to 3". At the same time, the height $H_s$ of the side portions 136 and 138 may be from about 2" to about 7". This arrangement is designed to provide deeper cradle for the head of the user while on the pillow while at the same time supporting the neck of the user located over a side portion of the bladder 132.

Figure 12:
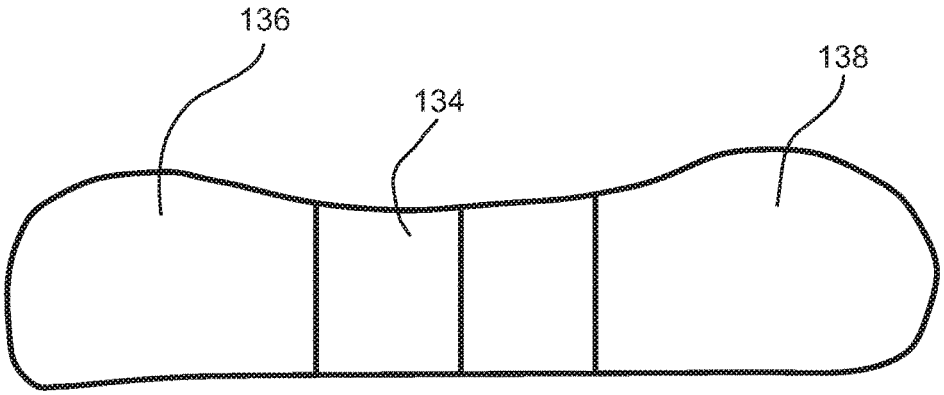
FIG. 12 is a cross-sectional view of the air-filled inflatable bladder.
Figure 13:
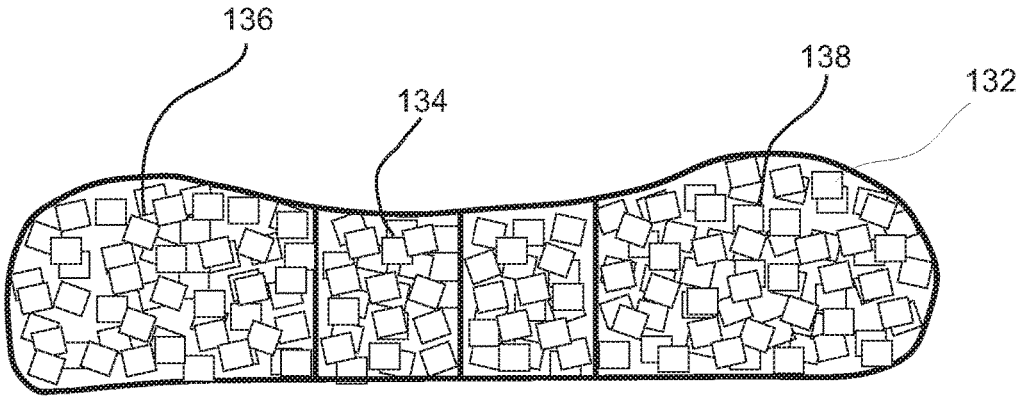
FIG. 13 is a cross-sectional view of the air-filled and foam-filled inflatable bladder.

In embodiments, the bladder 132 may be only filled with air as seen in FIG. 12. In other embodiments, the bladder 132 may be at least partially filled with a fill material—see FIG. 13. Having at least some foam inside the inflatable bladder 132 may be advantageous for a number of reasons: (i) it provides for initial inflation of the bladder 132 due to natural foam expansion, (ii) it provides for some resiliency of the bladder even without support from air pressure, (ii) it allows for a better control of the shape of the inflatable bladder 132, and (iv) it dampens oscillations and bouncing around when the user moved his head. For all these reasons, this design may be advantageous for manually-inflatable hollow pillows. The fill material inside the bladder 132 may be the same or different from the fill material of the upper comfort portion 110. In embodiments, the fill material of the bladder 132 may be selected to be more elastic and less soft than the fill material of the upper comfort portion 110 so as to provide better support for the user, while the upper comfort layer 110 can provide for a greater pressure distribution to increase user comfort.

A variety of mechanisms may be deployed to adjust the size of the opening, such as valves, manifolds, etc. to be convenient, such mechanism has to be small, easily reachable and simple to operate by feel and without looking, even in a dark room. In this case, a simple and quick adjustment to the pillow height may be made by a user while resting a head on the pillow.

Figure 14:
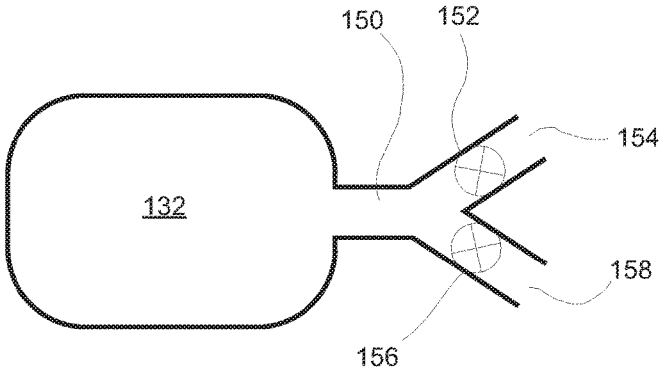
FIG. 14 is a schematic view showing a first opening of the bladder with a first valve and a second opening of the bladder with a second valve.

As discussed above, it is desirable to provide different size of an opening 150 into the inflatable bladder 132 during inflation and during deflation. FIG. 14 shows a cross-section schematic of a design of the bladder 132 equipped with two passages for air, one controlled by a first valve 152 and leading to a first opening 154 and the other controlled by a second valve 156 and leading to a second opening 158. During deflation, only one valve may be opened, for example a first valve 152, whereby providing a first size opening 154 to air removal. During inflation, either only a second valve 156 may be opened providing a larger opening 158 or alternatively both valves 152 and 156 may be opened providing for a larger yet combined opening size as a sum of opening 154 and opening 158. In embodiments, there may be provided a single opening into a bladder 132 which is split into two openings 154 and 158 as seen in FIG. 14 or two separate openings 154 and 158 may be directly coupled to the inflatable bladder 132 (not shown).

Figure 15:
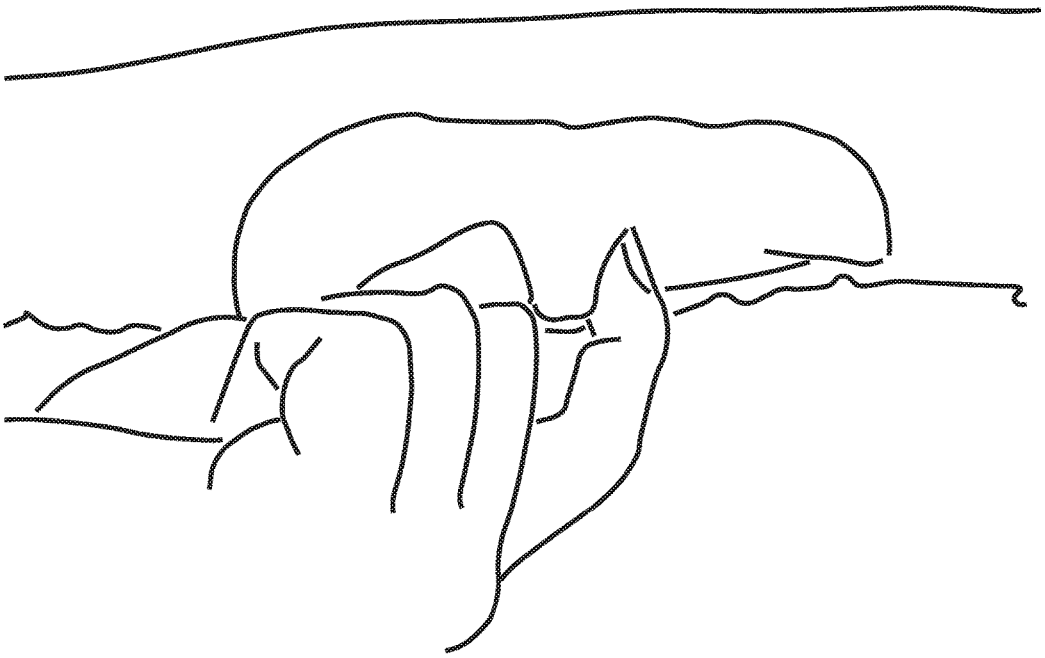
FIG. 15 is a close-up of the external view showing the adjustment portion of the pillow.

Manual operation of the valves 152 and 156 may be arranged by using two levers protruding on a side of the pillow 100 and optionally covered by a flexible fabric of the cover 180—see FIG. 15. These levers may be spring-loaded and designed to cause one or both valves 152 and 156 to be opened.

The present invention contemplates passive as well as assisted inflation of the bladder 132. In case of a passive inflation, a simple blow-in tube may be provided at the end of the opening 158, or alternatively, at the end of a combined passage fluidly connected to both openings 154 and 158. Such tubing may be designed to be tucked away under the bladder once adjustment is complete. Another way to cause passive inflation is to allow the inflatable bladder to expand based of expansion of the internal foam, which may have been previously compressed for storage purposes.

Figure 16:
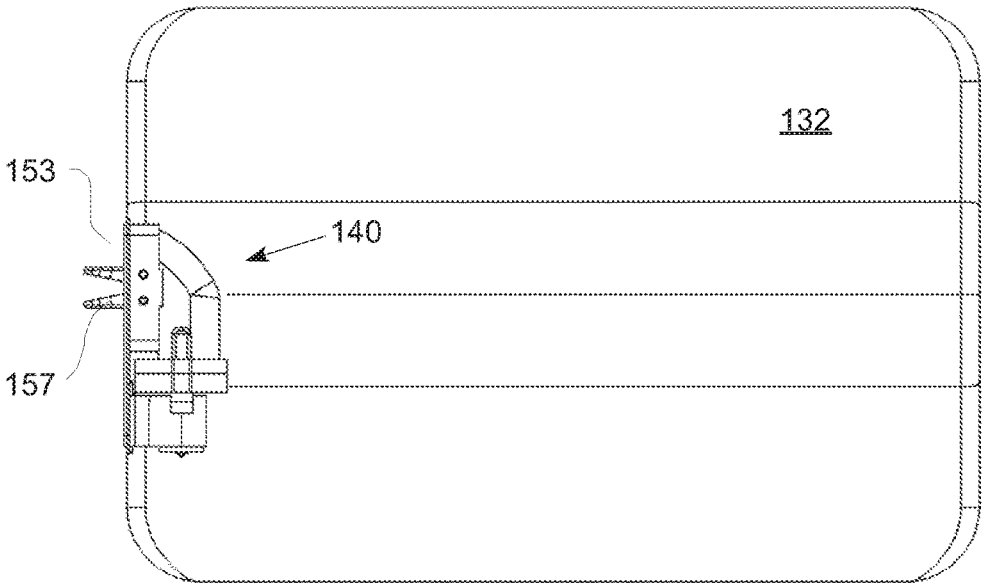
FIG. 16 is a top cross-sectional view of the bladder showing the air control assembly including a double-lever air valve.
Figure 17:
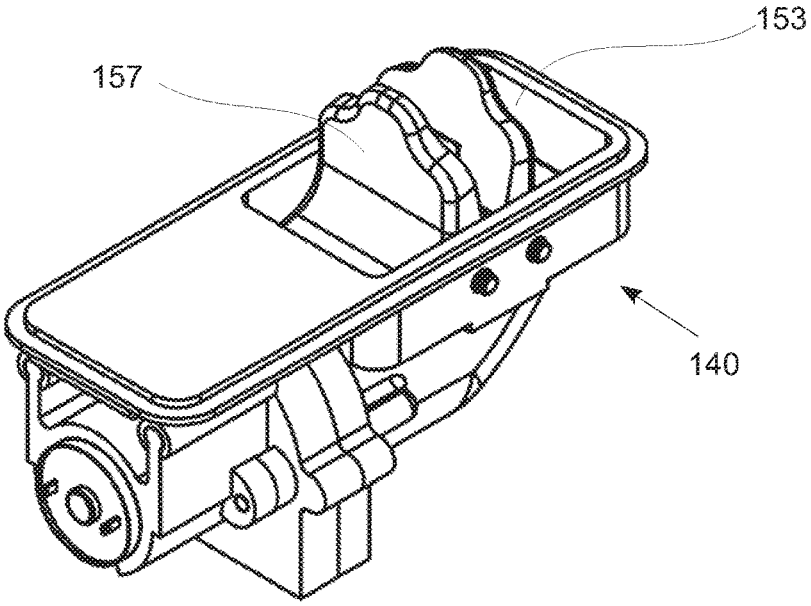
FIG. 17 is an axisymmetric view of the air control assembly of the pillow.

In another embodiment of the invention, inflation of the bladder may be conducted by an electrically driven air pump. In this case, the air control assembly 140 (see FIG. 16) may include all the elements needed for air handling procedure, including a battery, a motor, an air pump, and the valves to control the flow of air in and out of the bladder 132. The air control assembly 140 may be built into the bladder 132 in such a way that only control levers 153 and 157 protrude outwards from thereof. A closer view of the air control assembly 140 is seen in FIG. 17.

Figure 18:
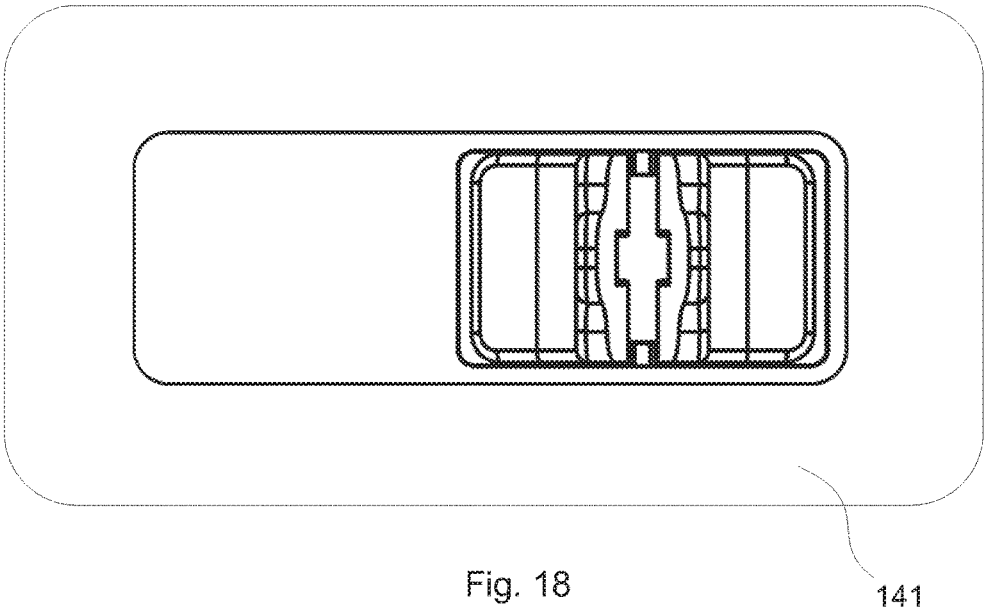
FIG. 18 is a top view of the air control assembly with incorporated flexible layer suitable for attaching to the bladder material.
Figure 19:
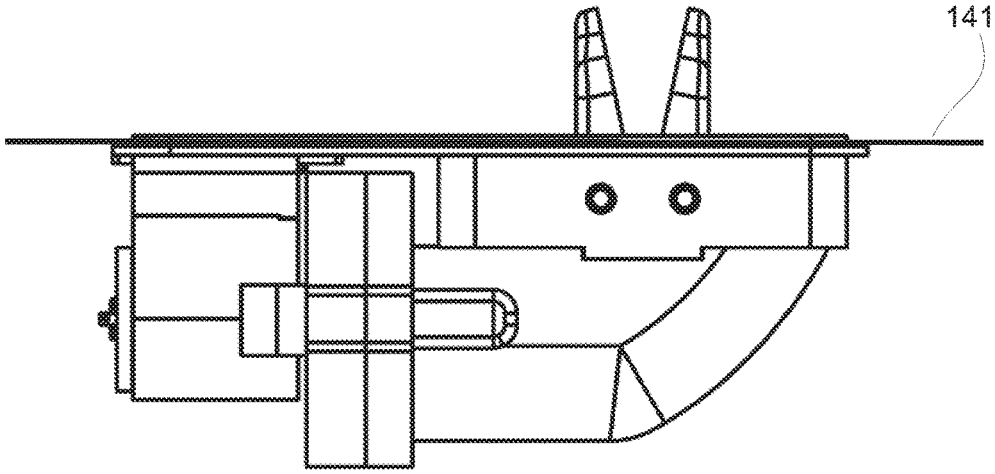
FIG. 19 is a side view of the same.

To facilitate attachment of the air control assembly 140 to the bladder 132, a polymer insert layer 141 may be incorporated with the air control assembly 140 during manufacturing—see FIG. 18 for a bottom view and FIG. 19 for a side view. In this case, the bladder 132 may be welded, glued or otherwise attached to the polymer layer 141 to sealingly assemble the air control assembly 140 inside the inflatable bladder 132. The polymer material of the insert 141 may be selected to be the same or of similar content as the material used for making an inflatable bladder 132 so as to facilitate the welding or another method of attachment between the air control assembly 140 and the inflatable bladder 132.

Figure 20:
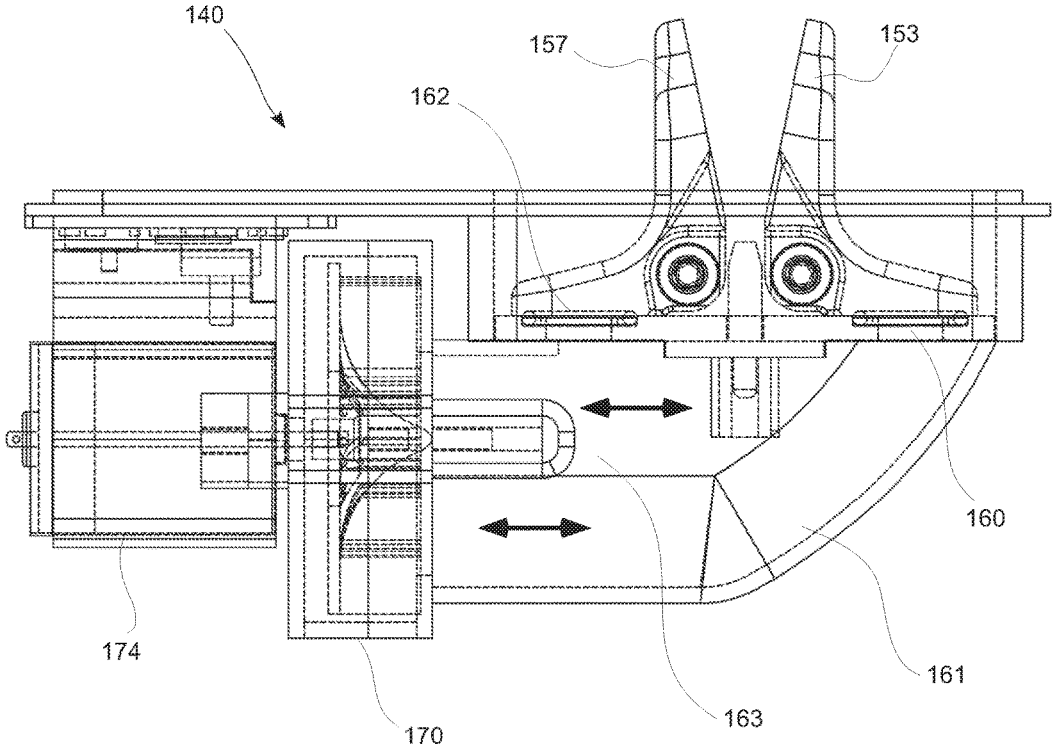
FIG. 20 is a side view of the air control assembly showing the components thereof.

The details of the air control assembly 140 are shown in FIG. 20. The air control assembly 140 generally includes an electrically-powered motor 174 rotating an impeller of the air pump 170. The motor 174 may be powered by a battery or another source of electrical power. The air pump 170 may be selected to provide enough air flow into the bladder for rapid inflation. The intake for the air pump may be divided into two sections—section 161 and section 163. The outlet of the air pump 170 may be opened into the surrounding inflatable bladder 132 (not shown in this figure).

The inlet section 161 may be shaped to terminate with an opening 162 comprising a stationary seal and a movable cover attached to a lever 153. Lifting the cover of the opening 162 by moving the lever 153 allows free air movement in and out of the bladder by passing through the intake section 161 and through the air pump 170.

Similarly, the inlet section 163 is terminated with an opening 162 comprising its own stationary seal and a movable cover, attached to a lever 157. Lifting the cover of the opening 162 by moving the lever 157 allows air to move through the inlet section 163 and further into the bladder 132.

Figure 21:
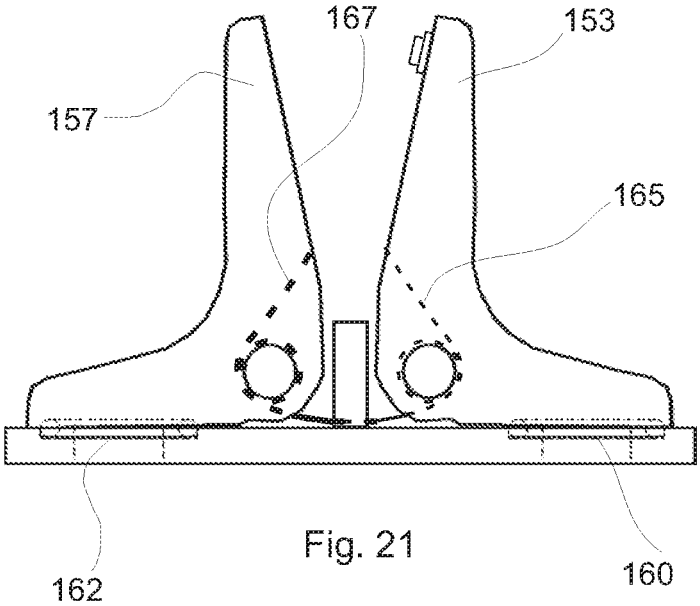
FIG. 21 is a side view of the double-lever air valve in its neutral closed position.

A further detail of the dual-lever valve is shown in FIG. 21. Both levers 157 and 153 are located close to each other and can be operated by moving each lever towards the other. The first lever 153 may be spring-loaded with a first spring 165 to urge the first valve to be in a normally closed position so as to keep the opening 160 closed when the lever 153 is not moved. The second lever 157 may be spring-loaded with a second spring 167 to urge the second valve to be in a normally closed position so as to urge the lever 157 to be in a position to keep the second opening 162 closed. In embodiments, the first spring 165 may be selected to be less strong than the second spring 167. In this case, pulling both levers 153 and 157 together will first result in moving the first lever 153 towards the second lever 157 and lifting the cover off the first opening 160—see FIG. 22.

Figure 22:
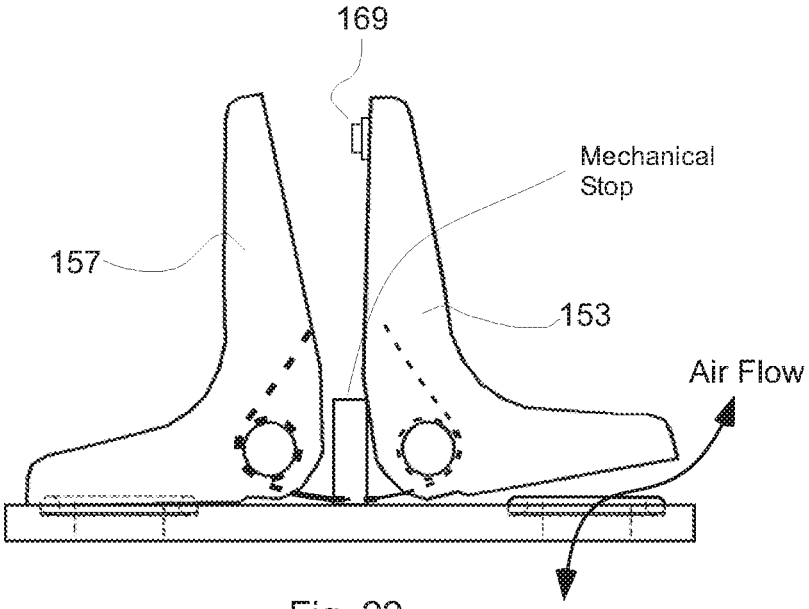
FIG. 22 is the same but with a first lever lifted.

The first lever 153 may be designed with built-in hard stops limiting its movement between a position when the cover seals the first opening 160 and a position when the first opening is sufficiently open while the lever 153 is in a vertical orientation as seen in FIG. 22. An electrical switch 169 may be provided on a lever 153. When activated, the electrical switch 169 may be configured to turn on air pump 170. Alternative switch designs are also contemplated to be within the scope of the invention, including optical and proximity sensing LED, magnetic switches and Hall Effect sensors as the invention is not limited in this regard.

As the spring 165 of the first lever 153 is selected to be less strong than the spring 167 of the second lever 157, pulling the levers 153 and 157 together will preferentially cause the lever 153 to move towards the lever 157 until its hard stop will cause it to stop in a vertical position—see FIG. 22. In this case, only the first opening 160 will be open. This configuration may be used for a slower deflation of the pillow during its adjustment process. In use, the user head is assumed to be on the pillow of the invention. Reaching out and squeezing both levers 153 and 157 together with a single hand with a first lower force will cause the first opening to be open and will let the air out of the pillow for the purposes of height adjustment when the head of the user is on the pillow.

Figure 23:
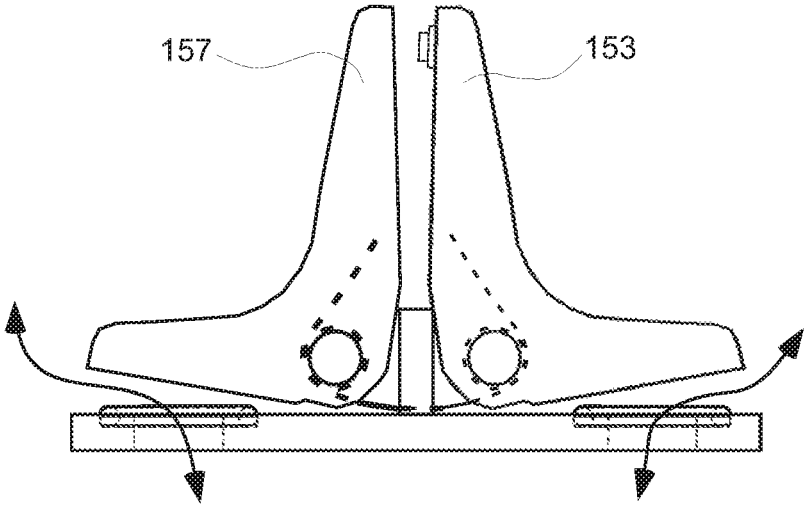
FIG. 23 is the same but with both levers lifted.
Figure 24:
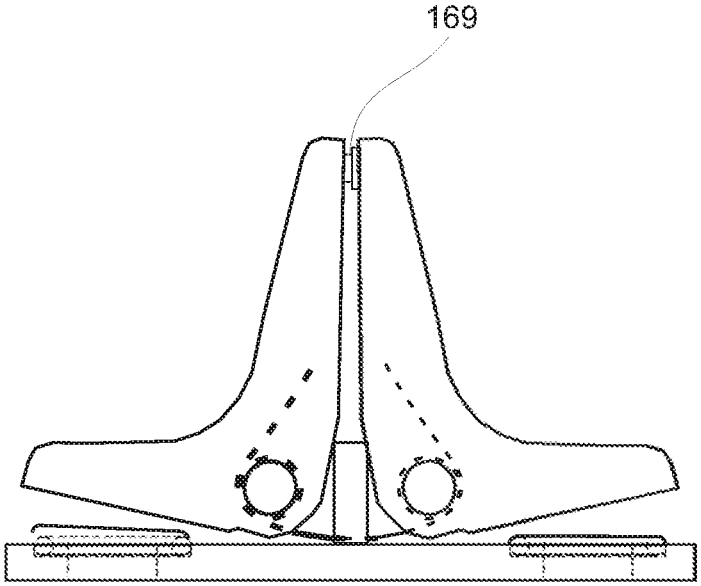
FIG. 24 is the same as shown in FIG. 23 but with an electrical switch between the first and the second lever activated.

Further action to move both levers 153 and 157 of the double-lever air valve together will cause the second lever 157 to move towards the first lever 153—see FIG. 23. At this point, both the first opening 160 and the second opening 162 are open providing a greater passage into the inflatable bladder 132. Completing of the action of bringing both levers 153 and 157 together activates the switch 169 which in turn causes activation of the air pump 170—see FIG. 24. Once the air pump is turned on, air from outside would flow inside the bladder via both passages 161 and 163 so that the bladder can be rapidly inflated. Release of the levers 153 and 157 would de-activate the switch 169, turn off the motor 174, stop the air pump 170 and close off both passages 161 and 163, whereby trapping injected air inside the bladder 132.

Figure 25:
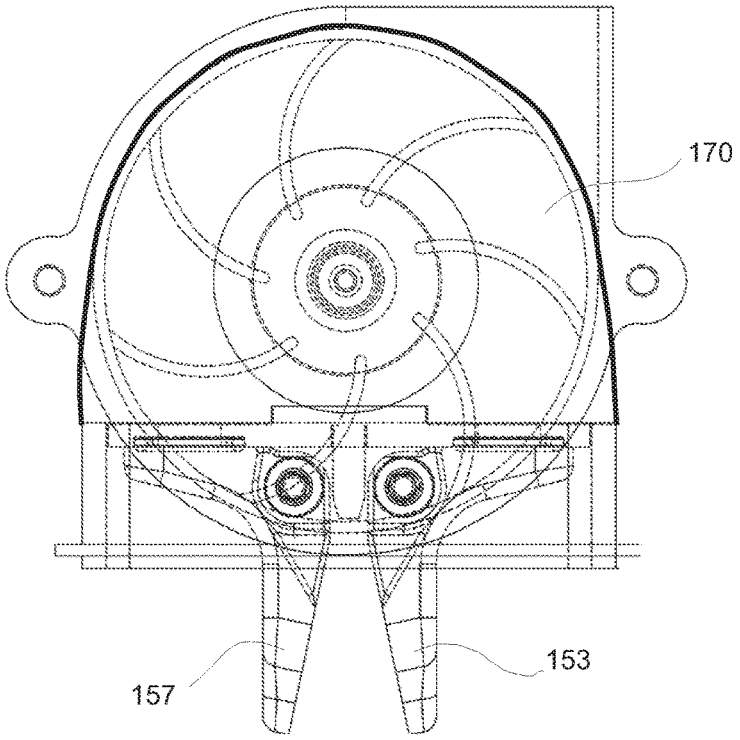
FIG. 25 is an alternative configuration of the air pump and the double-lever air valve.
Figure 26:
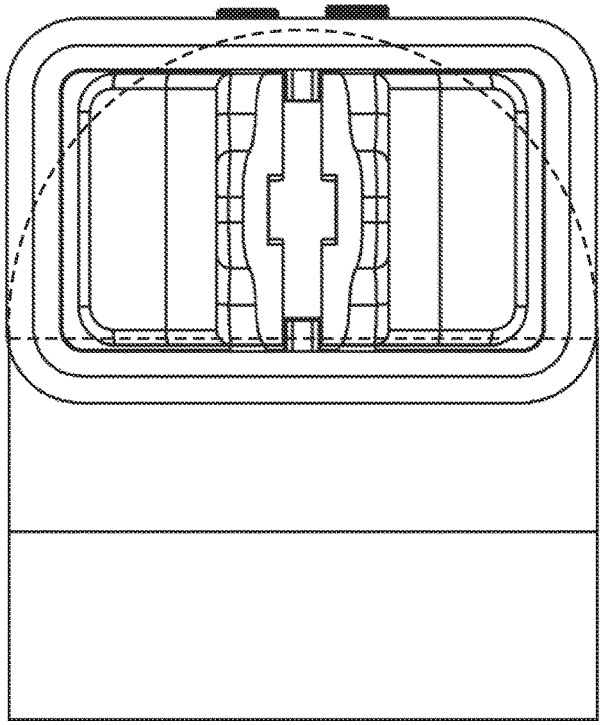
FIG. 26 is the side view of the same.

FIG. 25 shows an alternative configuration of the air control assembly 140 in which the air pump 170 as well as the motor 174 (not seen in the figure) are rotated 90 degrees—this configuration provides for a more "flat" shape of the air control assembly 140, which may be advantageous in supporting the assembly. A side view of this embodiment of the air control assembly is seen in FIG. 26.

Figure 27:
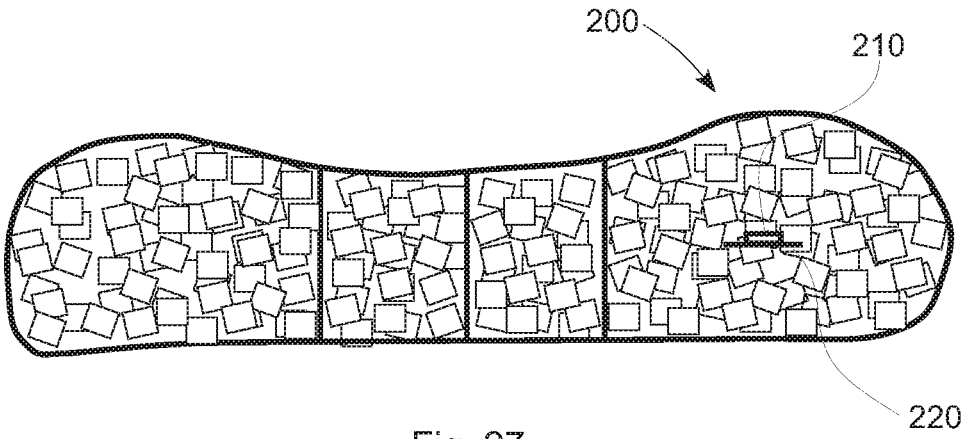
FIG. 27 is a side view of the bladder with incorporated silent vibration alarm.
Figure 28:
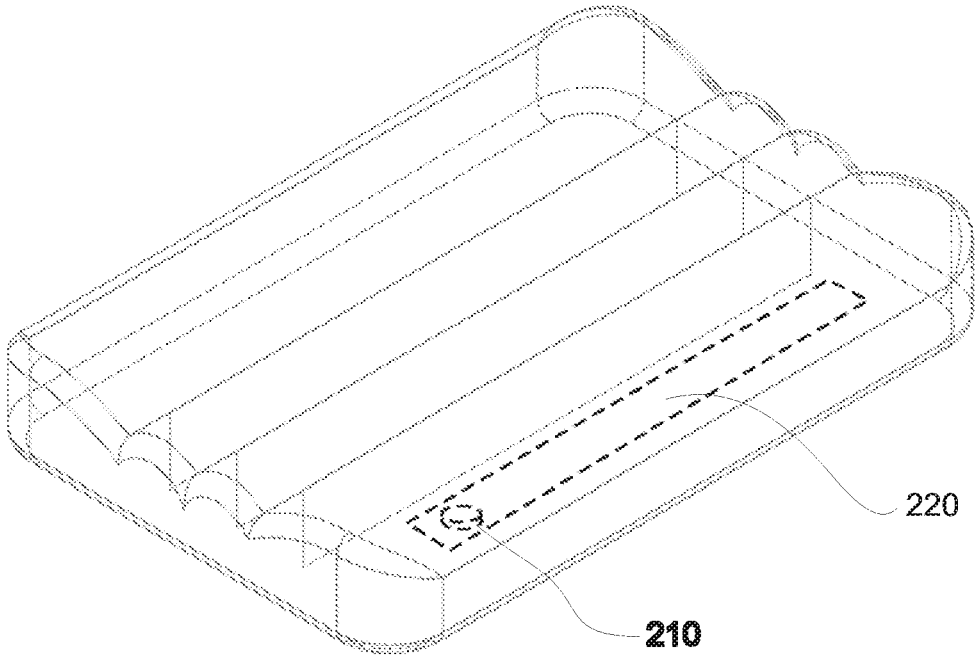
FIG. 28 is the axisymmetric view of the same.

Additional features may be provided by the novel pillow of the present invention. One such feature is a silent wake-up alarm illustrated in FIGS. 27, 28, and 29. Traditional vibration alarms provided in various pillows of the prior art are not silent. They utilize a motor which is used to rotate a cam to create vibration, and in turn wake up a user. While effective, such systems are not silent, which may cause a partner of the user who sleep nearby to wake up as well.

Figure 29:
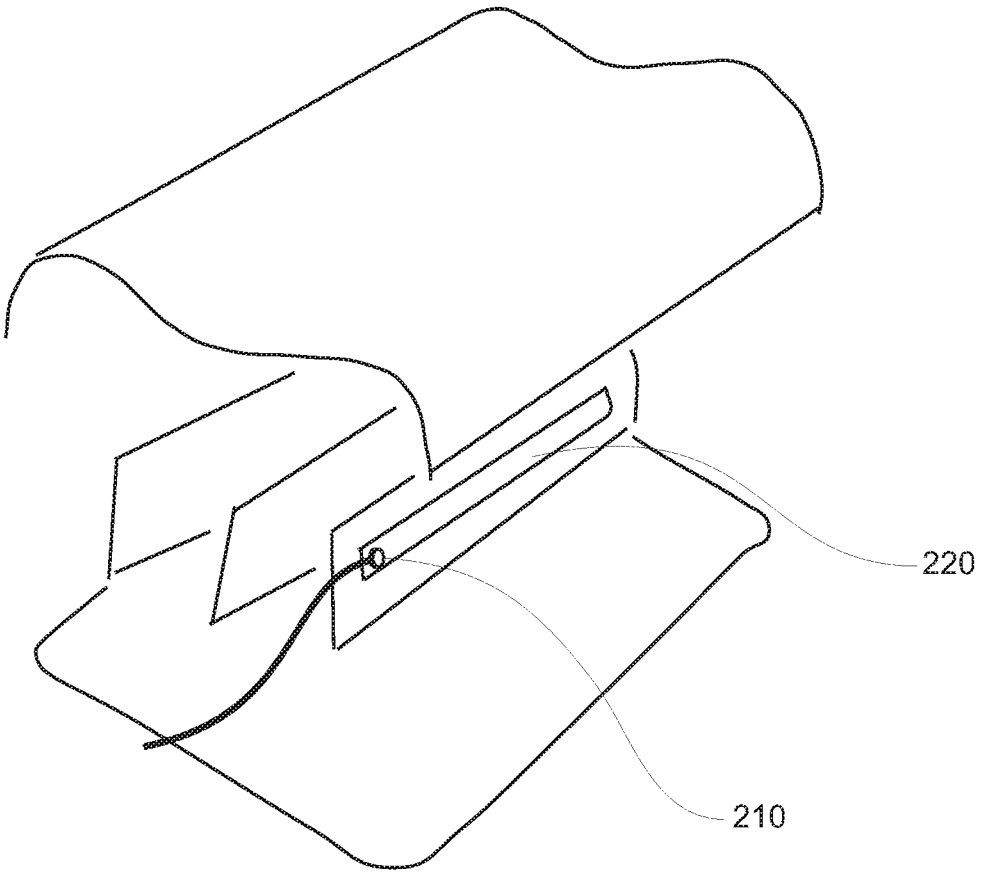
FIG. 29 is an exploded view of the same showing details of the vibration alarm assembly.

The present invention addresses this problem by providing a silent vibration alarm system 200 built into the pillow 100—see FIGS. 29 and 30. In embodiments, the vibration alarm system comprises a resonating strip 220 attached to an actuator 210 and contained within the inflatable bladder 132 to conceal any acoustic noise emanating therefrom. The actuator 210 and/or the resonator strip 220 may be attached to, built in or otherwise supported by one of the ribs 133 of the inflatable bladder 132—see FIG. 29. In other embodiments, the actuator 210 and/or the resonating strip 220 may be contained within the foam fill of the inflatable bladder 132—see FIG. 27, which may lead to better acoustic insulation of the actuator 210 upon activation thereof. The actuator 210 may be electrically powered via a cable 212 and adapted to apply a frequency of vibrations in a way to cause the strip 220 to oscillate on its resonant frequency. Resonance oscillations are designed to reverberate throughout the pillow 100 to wake up the user. At the same time, acoustic noise is suppressed both within the inflatable bladder 132 as well as by the upper comfort layer 110 so as not to disturb the partner of the user.

The strip 220 may be selected to have a length generally close to the length of the bladder 132—this will assure a consistent feeling of vibrations at any location throughout the pillow 100. The width of the strip 220 may be selected to be 0.2; 0.3; 0.4; 0.5; 0.75; 1, 1.25; 1.5; 2 inches or any width inbetween. Polystyrene may be a suitable material for making the strip 220. Material selection and size choices may be made to cause the strip 220 to oscillate in a resonance frequency from about 100 Hz to about 250 Hz. In embodiments, the resonance frequency may be selected to be 100; 110; 120; 130; 140; 150; 160; 170; 180; 190; 200; 210; 220; 230; 240; 250 Hz or any frequency inbetween.

It is contemplated that any embodiment discussed in this specification can be implemented with respect to any method of the invention, and vice versa. It will be also understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), propertie(s), method/process steps or limitation(s)) only.

The term "or combinations thereof" as used herein refers to all permutations and combinations of the listed items preceding the term. For example, "A, B, C, or combinations thereof" is intended to include at least one of: A, B, C, Aft AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, Aft BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12, 15, 20 or 25%.

All of the devices and/or methods disclosed and claimed herein can be made and executed without undue experimentation in light of the present disclosure. While the devices and methods of this invention have been described in terms of preferred embodiments, it will be apparent to those of skill in the art that variations may be applied to the devices and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. An inflatable pillow comprising an inflatable bladder, an air pump with an outlet operably connected to and configured to inflate said inflatable bladder when said air pump is activated by an electrical switch, and a spring-loaded valve configured to control air intake for said air pump, said valve is configured to be normally-closed to seal off said inflatable bladder, said valve is further configured when partially activated to allow reduction of a height of said inflatable pillow by opening a first passage causing deflation of said inflatable bladder through said air pump without energizing thereof, said valve is further configured when fully activated to increase the height of said inflatable pillow by opening a second passage in addition to said first passage and activating said electrical switch, causing energizing of said air pump and inflation of said inflatable bladder through both said first passage and said second passage forming a cumulative inflation passage sized to be larger than said first passage, whereby proceeding from partial activation of said valve to full activation thereof causing a reversal of air flow from deflation of said inflatable bladder to inflation thereof.

2. The inflatable pillow as in claim 1, wherein said first passage is sized to have a cross-section area of between about 0.15 $in^2$ and 0.35 $in^2$.

3. The inflatable pillow as in claim 1, wherein said second passage is sized to have a cross-section area of between about 0.15 $in^2$ and 0.50 $in^2$.

4. The inflatable pillow as in claim 1, wherein said spring-loaded valve is further comprising a first valve to control deflation of said inflatable bladder and a second valve to control together with said first valve the inflation of said inflatable bladder.

5. The inflatable pillow as in claim 4, wherein said spring-loaded valve is further comprising a double-lever air valve with a first lever configured to operate said first valve and a second lever configured to operate said second valve.

6. The inflatable pillow as in claim 5, wherein said first lever is spring-loaded with a first spring to urge said first valve to be in a normally closed position, said second lever is spring-loaded with a second spring to urge said second valve to be in a normally closed position, said first lever and said second lever are positioned to face each other.

7. The inflatable pillow as in claim 6, wherein said first spring is less strong than said second spring, whereby pulling the first lever and the second lever together causing said first lever to move first so as to cause said first valve to open prior to opening of said second valve, whereby said inflatable pillow is put in a state suitable for deflation, while further pulling of said first lever and said second lever causing opening of both said first valve and said second valve put said inflatable pillow in a state suitable for inflation.

8. The inflatable pillow as in claim 7, wherein said electrical switch is positioned between said first lever and said second lever and configured such that pulling said first lever and said second lever together causing activation of said electrical, switch leading to activation of said electrical motor and said air pump leading in turn to inflation of said inflatable bladder and increasing the height of said inflatable pillow.

9. The inflatable pillow as in claim 1 wherein said inflatable bladder is generally shaped as a rectangle and comprising one or more intermediate ribs defining a central section located inbetween two side sections, wherein said central section has a lower height as then said side sections.

10. The inflatable pillow as in claim 1, wherein said inflatable bladder is filled with a fill material.

11. The inflatable pillow as in claim 10, wherein said fill material is foam.

12. The inflatable pillow as in claim 1 further comprising an upper comfort portion filled with a fill material configured to distribute pressure over said inflatable pillow.

* * * * *